US006536442B2

(12) United States Patent
St. Charles et al.

(10) Patent No.: US 6,536,442 B2
(45) Date of Patent: Mar. 25, 2003

(54) LIGHTER INTEGRAL WITH A SMOKING ARTICLE

(75) Inventors: Frank K. St. Charles, Perry, GA (US); Kayyani C. Adiga, Macon, GA (US); Robert Scott Driskell, Macon, GA (US); Terry S. Goodrich, Lizella, GA (US); Mark B. Zeuner, Warner Robins, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 14 days.

(21) Appl. No.: 09/734,510

(22) Filed: Dec. 11, 2000

(65) Prior Publication Data

US 2002/0100487 A1 Aug. 1, 2002

(51) Int. Cl.[7] ..... A24F 13/04; A24F 3/00; F23Q 11/00

(52) U.S. Cl. ..... 131/194; 131/185; 131/351; 131/329; 431/253; 431/268

(58) Field of Search ..... 131/185, 191, 131/194, 234, 351, 198.2, 198.1, 329; 431/143, 142, 144, 156, 253, 268, 344; 128/202.21

(56) References Cited

U.S. PATENT DOCUMENTS

| | | | | |
|---|---|---|---|---|
| 1,292,591 A | | 1/1919 | Elkins | |
| 1,800,334 A | | 4/1931 | Aronson | |
| 2,499,752 A | | 3/1950 | Hrabal | |
| 2,505,047 A | | 4/1950 | Horning | |
| 2,974,669 A | | 3/1961 | Ellis | |
| 3,844,707 A | | 10/1974 | Wormser | |
| 3,915,623 A | | 10/1975 | Wormser | |
| 4,003,694 A | | 1/1977 | Lowell | |
| 4,066,088 A | | 1/1978 | Ensor | |
| 4,076,014 A | | 2/1978 | Wiquel | |
| 4,207,055 A | | 6/1980 | Tamaka | |
| 4,223,687 A | | 9/1980 | Sandeen | |
| 4,235,588 A | | 11/1980 | Tamaka | |
| 4,531,906 A | | 7/1985 | Mizukami | |
| 4,596,525 A | | 6/1986 | Hsu | |
| 4,634,374 A | | 1/1987 | Herko | |
| 4,640,679 A | | 2/1987 | Perrin | |
| 4,653,999 A | | 3/1987 | Dennis, Jr. et al. | |
| 4,850,854 A | * | 7/1989 | Buck | 431/143 |
| 4,929,174 A | | 5/1990 | Wang | |
| 5,044,933 A | | 9/1991 | Yang | |
| 5,109,817 A | * | 5/1992 | Cherry | 123/272 |
| 5,161,964 A | | 11/1992 | Frigiere et al. | |
| 5,346,392 A | | 9/1994 | Kim | |
| 5,915,953 A | * | 6/1999 | Mifune et al. | 431/268 |
| 6,349,728 B1 | | 2/2002 | Pham | |

OTHER PUBLICATIONS

Chemical Analysis by Observation of Spectra Annalen der Physik und der Chemie (Poggendorff), vol. 110 (1860), pp. 161–189 (dated Heidelberg, 1860).

Annalen der Physik, und der Chemie (Poggendorf), 100: 1857 III/ Photochemische Untersuchungen; R. Bunsen und H. Roscoe pp. 43–89.

* cited by examiner

*Primary Examiner*—Steven P. Griffin
*Assistant Examiner*—Dionne A. Walls
(74) *Attorney, Agent, or Firm*—Charles G. Lamb; John F. Salazar; Middleton Reutlinger

(57) ABSTRACT

A lighter integral with a smoking article includes a gas burner and a tube for receiving a smokable material, such as a cigarette. The gas burner generates a stable pre-mixed flame that is used to heat the material to be smoked. The smokable material may be separated from the heat source, such as a flame or a catalyst bed, by a barrier that allows heat to flow between the heat source and an interior portion of the tube. Various configurations of barriers are provided. Furthermore, an attachment is provided that allows for the conversion of a conventional lighter into a lighter that may be integrally combined with a smoking article.

57 Claims, 12 Drawing Sheets

LIGHTER INTEGRAL WITH A SMOKING ARTICLE

BACKGROUND OF THE INVENTION

1. Field of the Invention

This invention relates generally to smoking articles and combustion means therefore. More particularly, the present invention relates to a constituent lighter which is integrally combined with a smoking article employing combustion of a pre-mixed gaseous fuel.

2. Description of the Related Art

Cigarette lighters that produce pre-mixed flames are well known in the art. For example, U.S. Pat. No. 3,915,623 teaches a burner for a cigarette lighter in which gaseous fuel is mixed with air prior to ignition in order to generate a stable flame. Also, U.S. Pat. No. 4,929,174 teaches a lighter in which gaseous fuel is mixed with air drawn into the lighter through an air vent, after which the fuel/air mixture is combusted in a combustion chamber. A pre-mixed flame is the product of a combustion process wherein the fuel is mixed with air in near stoichiometric proportions upstream of the ignitor and proceeds to nearly complete reaction upon ignition. Due to the near complete combustion reaction, the process produces almost no soot, uncombusted fuel nor products of incomplete combustion. Also, since the fuel is pre-mixed with air, the flame is not dependent upon the orientation of the lighter and it is able to burn within an enclosed space. Cigarette lighters that generate pre-mixed flames generally use venturies to entrain air, which is then mixed in nearly a stoichiometric ratio with a gaseous fuel to produce a mixture that, when combusted, generates the pre-mixed flame.

However, cigarette lighters are generally provided separately from the article that is to be smoked. As a result, the article to be smoked must generally be ignited in order to supply sufficient heat to the material with the smoking article that generates the smokable aerosol inhaled by the user. The ability to smoke an article without igniting the material to be smoked may provide certain advantages over previously known smoking articles. More particularly, a smoking article that does not have ignited tobacco or other smokable material may be less likely to generate inadvertent fires.

Inhalable aerosol generating devices that heat the aerosol generating material are also known in the art. WO 97/48294 discloses a device that heats a flavor-generating material using a combustible fuel. The heating device generates an unmixed diffusion flame and a heat exchanger to heat indirectly the air that contacts the flavor generating material. The heating device requires ducts through which off-gas from the combustion process may be vented. Such off-gas includes unreacted fuel and products from incomplete combustion. Such an indirect heating device expends more energy and requires a greater fuel storage capacity than a device in which the flavor-generating material is directly heated It is therefore desirable to provide a smoking article having a lighter integral thereto by which a smokable material contained within the smoking article is directly heated without being ignited.

SUMMARY OF THE INVENTION

It is an object of the present invention to provide a lighter integral with a smoking article.

It is another object of the present invention to provide a lighter integral with a smoking article providing a pre-mixed flame.

It is a further object of the present invention to provide an attachment for a lighter to convert a conventional lighter to a lighter integral with a smoking article.

It is still a further object of the present invention to provide an integral lighter for a smoking article in which a flavor-generating material is directly heated without ignition thereof.

More particularly, the present invention is directed to a constituent lighter integral with a smoking article. The constituent lighter includes a tube and a gas burner which produces a stable, pre-mixed flame that may be contained within an enclosed space, such as a tube or flame chamber. The tube is sized to receive a rod containing a smokable material such as tobacco. The tube has an open distal end into which the rod may be inserted. A heat-conducting barrier is also included in the constituent lighter, so as to prevent the end of the rod from entering the flame chamber. The tube is in flow communication with the gas burner. The gas burner may include a flame chamber, a flame holder, a mixing chamber, at least one air inlet, and a nozzle. The nozzle is in flow communication with a fuel storage container in which is housed a gaseous fuel. The gas burner may also include an optional catalyst bed that may be activated by ignition of fuel within the burner.

In use, fuel is fed from the fuel storage container to the nozzle. The nozzle constricts the flow path of the fuel, thereby increasing the flow velocity. Once the gaseous fuel leaves the nozzle, the static pressure of the flow drops, thereby drawing air into the burner through the air inlet(s). The fuel and air travel to the mixing chamber where they become thoroughly mixed. The mixing chamber is in flow communication with the flame holder. The fuel/air mixture flows out of the mixing chamber, past the flame holder to the ignitor, which ignites the fuel/air mixture upon activation. The combustion of the fuel/air mixture produces a stable, pre-mixed flame that is contained within the flame chamber and is prevented from flashing back through the burner by the flame holder. With the proper fuel-to-air ratio, the combustion process produces virtually no soot, uncombusted fuel nor products from incomplete combustion. A rod containing a smokable material, such as tobacco, is inserted in the tube of the constituent lighter. The heat-conducting barrier allows heat transfer from the gas burner to the interior of the tube, while preventing the smokable rod from entering the flame chamber. The flame generated and contained in the flame chamber heats the rod for smoking. Alternatively, if the constituent lighter includes a catalyst bed, then the bed may be activated so as to heat the rod to a sufficient temperature to allow the rod to be smoked. In this case, the heat-conducting barrier separates the smokable rod from the catalyst bed, while allowing heat transfer therebetween. At least one opening contained within the side wall of the tube allows air to be drawn into the tube to the smokable rod by puffing. Alternatively, a gap may be formed between the tube and the burner, through which air may be drawn into the tube. In this manner, a smokable material may be smoked within an article having a constituent lighter.

The lighter of the present invention may be included in smoking articles having various configurations. The smoking article may have a cigarette or cigar-shaped configuration; or, it may be shaped like a pipe. Another embodiment of the smoking article may be shaped like a conventional lighter with a tube extending therefrom. The smokable material may include any known aerosol-generating material well known in the art, such as tobacco. The smokable material may be packaged in a rod, such as a cigarette, or it may alternatively be loose material.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 1A:
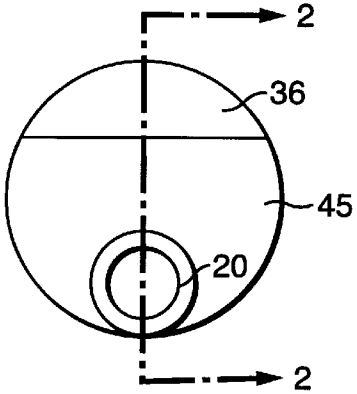
FIG. 1*a* is an end view of the constituent lighter of FIG. 1.

As shown in the figures, a constituent lighter 10 for a smoking article is provided. The constituent lighter 10 includes a gas burner 11 which produces a pre-mixed flame through the combination of a gaseous fuel with air introduced through at least one first air inlet or opening 60 disposed in the body of the constituent lighter 10. The gas burner 11 is in flow communication with a tube 20 into which a rod 119 containing a smokable material may be inserted. The tube 20 has a distal or first open end 22 open to ambient, an opening 35 in a side wall thereof, through which air may be puffed during use of the smoking article, and a second end 12 opposed to the first end which is in flow communication with the gas burner 11.

Figure 3:
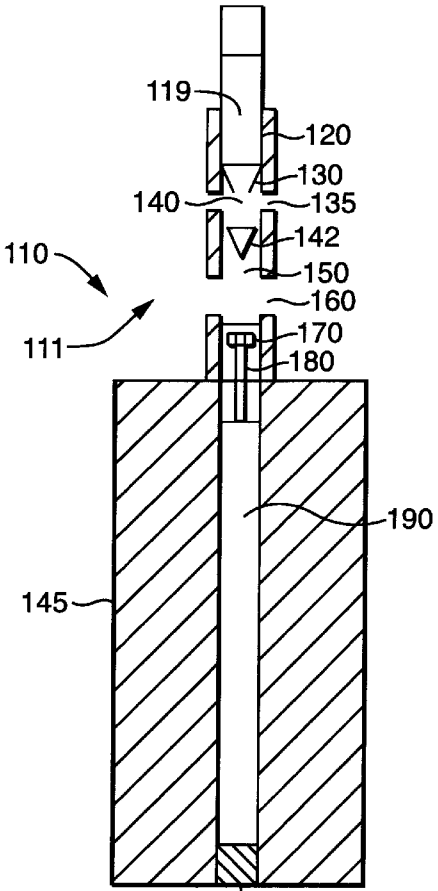
FIG. 3 is a cross-sectional view of another embodiment of the constituent lighter of the present invention.

The smoking article 110, as shown in FIG. 3, may include a smokable material such as a tobacco or another aerosol-generating material disposed in a cigarette 119 or rod and the constituent lighter 10 that is attached to the article containing the smokable material.

Figure 1:
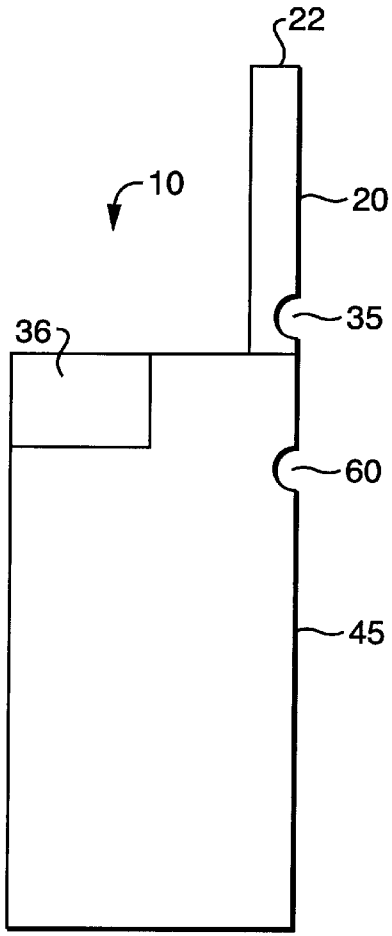
FIG. 1 is a side view of a constituent lighter of the present invention to be integrally attached to a smoking article.

As shown in FIGS. 1 and 1*a*, the constituent lighter 10 has a tube 20 extending from a lighter body 45. The tube 20 is hollow, open at the distal end 22, and may be sized to receive a rod containing a smokable material. For example, the tube 20 may be sized to receive the distal end of a conventional cigarette. Alternatively, the constituent lighter 10 may include a tube 20 that is sized for a rod specifically designed for use with the constituent lighter. The rod may contain any smokable material known in the art, such as tobacco or another aerosol-generating material. The tube 20 includes at least one second opening or air inlet 35, which is open to ambient. Second opening 35 allows air to be drawn into tube 20 by puffing on the rod disposed therein. Furthermore, constituent lighter 10 may also include an activation button 36 that, when depressed, activates the gas burner 11 contained therein. The present invention encompasses other forms of actuators well known in the art that activate the gas burner contained therein. An air inlet 60 is also shown in FIG. 1. Like second opening 35, air inlet 60 is open to ambient to allow air to be drawn into the gas burner of the constituent lighter 10.

Figure 2:
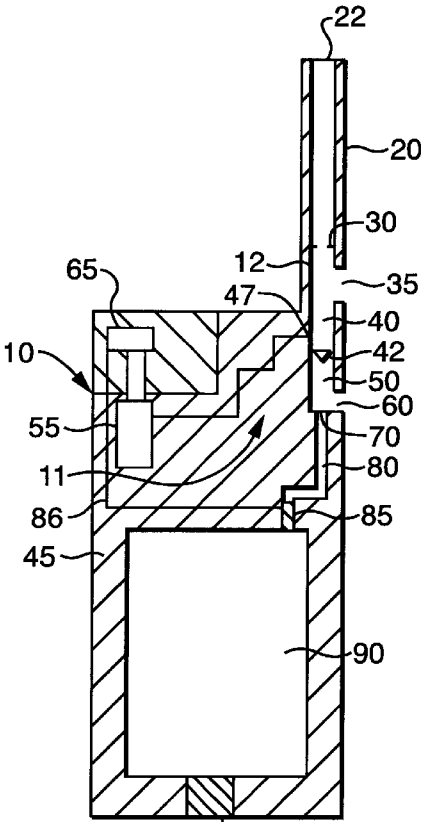
FIG. 2 is a cross-sectional view of the constituent lighter of FIG. 1*a* taken along line 2—2.
Figure 4:
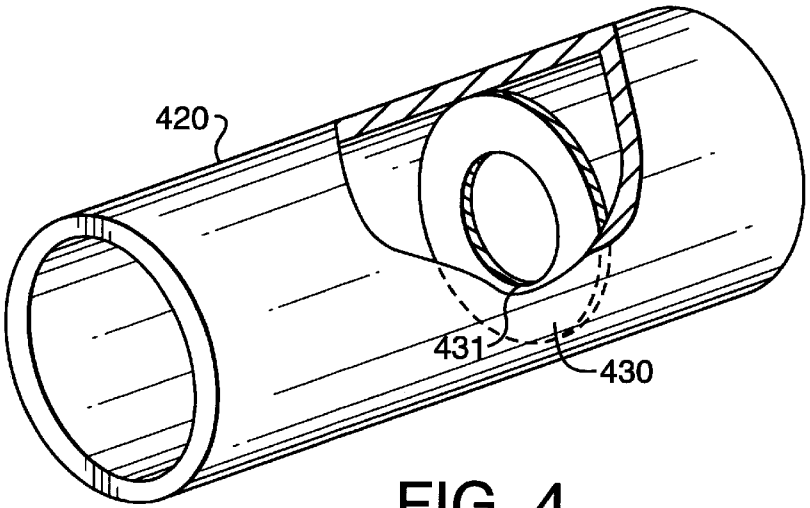
FIG. 4 is a perspective view of the tube of the constituent lighter of FIG. 1 with selected portions cut away and other selected portions in phantom lines.

FIG. 2 shows the gas burner of the constituent lighter. The gas burner includes a fuel storage container 90 that contains a gaseous fuel and has a refill valve 95 attached thereto. The gaseous fuel may be any combustible material with a vapor pressure greater than one atmosphere at the temperature of use. The gaseous fuel may include hydrogen, and/or carbon monoxide and/or a low molecular weight hydrocarbon, such as methane, ethane, propane, butane, acetylene or mixtures thereof. A fuel line 80 is in flow communication with the fuel storage container 90 and conducts gaseous fuel from the fuel storage container 90 to a nozzle 70. A fuel line valve 85 is disposed in flow communication with the fuel storage container 90 and the fuel line 80. Mechanical connector 86 connects fuel line valve 85 with an activator switch 65 which is in communication with activator button 36. When activator switch 65 is activated, it will open the fuel line valve 85. Alternatively, fuel line valve 85 may be manipulated to adjustably regulate the flow rate of the fuel through the fuel line 80. Yet another alternative includes a flow rate regulator pin (not shown), in flow communication with the fuel storage container 90.

As fuel flows through the fuel line 80, the nozzle 70 increases the velocity and reduces the static pressure of fuel traveling therethrough. A mixing chamber 50 is in flow communication with the nozzle 70. Fuel enters the mixing chamber 50 from the nozzle 70 where it mixes with air entrained through at least one air inlet 60, which is in flow communication with mixing chamber 50. First air inlet(s) or openings 60 are open to ambient and conduct air to the mixing chamber 50. Air is drawn into the mixing chamber 50 due to venturi effect, which is the reduction in static pressure of the fuel traveling through the nozzle 70 into mixing chamber 50. Within mixing chamber 50, the gaseous fuel and air mix so as to form a fuel/air stream that is within the combustion limits of the particular fuel. This fuel/air stream will be combusted farther downstream within the gas burner 11.

A flame holder 42 is in flow communication with mixing chamber 50. Flame holder 42 may be a porous plate or other structure known in the art that allows the fuel/air mixture to flow downstream past the flame holder 42. Flame holder 42 prevents a flame generated from the combustion of the fuel/air mixture from flashing back through the gas burner. Flame holder 42 is disposed at the inlet of a flame chamber 40. An ignitor 47 is disposed in flow communication with the mixing chamber 50 and flame chamber 40. The ignitor 47 may be any ignition means well known in the art, such as a piezoelectric 55, battery or flint ignitor. The ignitor 47 may be in communication with activation switch 65, as shown in FIG. 2. Fuel flows past the flame holder 42 into flame chamber 40 where it is combusted upon activation of the ignitor 47. The combustion process proceeds to near complete reaction due to the pre-mixing of the air and gaseous fuel. The flame generated in the combustion process is a stable, pre-mixed flame that will not bend due to the orientation of the constituent lighter 10. This flame is contained within the flame chamber 40. As shown in FIG. 3, a cigarette or rod 119 containing a smokable material disposed within tube 120 is prevented from entering flame chamber 140 by heat-conducting barrier 130. However, direct heat transfer is possible between the gas burner and the rod 119. Therefore, the flame generated in flame chamber 140 may heat cigarette 119 so as to allow the user to smoke.

As shown in FIG. 2, a heat-conducting barrier 30 is disposed between the interior of flame chamber 40 and the interior of tube 20. Heat-conducting barrier 30 may include any configuration and material of construction that prevents a cigarette disposed within tube 20 from entering flame chamber 40, while allowing heat transfer between the flame generated in flame chamber 40 and the interior of tube 20. For example, the heat-conducting barrier 30 may be formed of a metallic, ceramic, polymeric material, or the like. Preferred heat-conducting barriers 30 may be formed of metal or ceramic components. Furthermore, heat-conducting barrier 30 may be disposed either within tube 20 or outside of tube 20, but adjacent thereto. Also, heat-conducting barrier 30 may be integrally formed with tube 20 or another element of the constituent lighter 10 of the present invention, or it may be removably disposed therein.

As indicated above, FIG. 3 shows a cigarette 119 disposed in another embodiment of the constituent lighter 110 in which a portion of gas burner 111 projects from body 145. Cigarette 119 is disposed in tube 120 and separated from flame chamber 140 by heat conducting barrier 130. Opening 135 allows puffing air to be drawn into tube 120 by the user. Gas burner 111 also includes a flame holder 142 disposed between a mixing chamber 150 and the flame chamber 140. Mixing chamber 150 is in flow communication with air inlet 160 and nozzle 170. A more stream-lined fuel storage container 190 is connected to a fuel line 180 and a refill valve 195.

Figure 5:
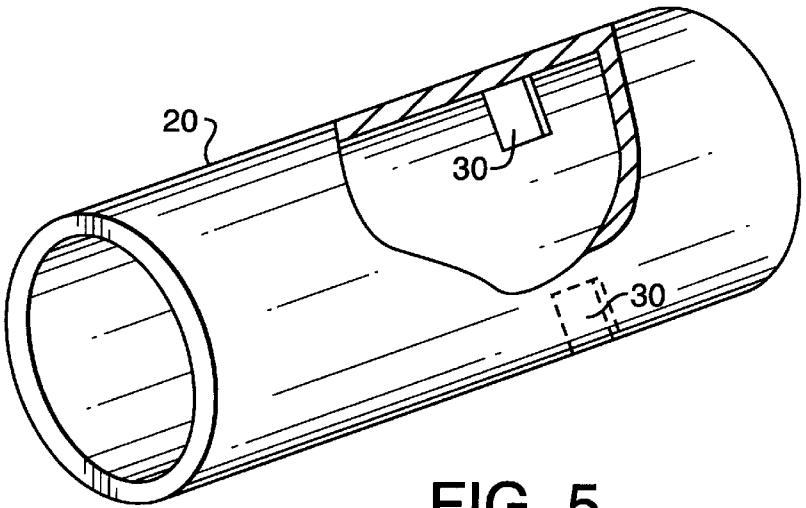
FIG. 5 is a perspective view of the tube of the constituent lighter of FIG. 1 containing another embodiment of the heat-conducting barrier with selected portions cut away and other selected portions in phantom lines.
Figure 6:
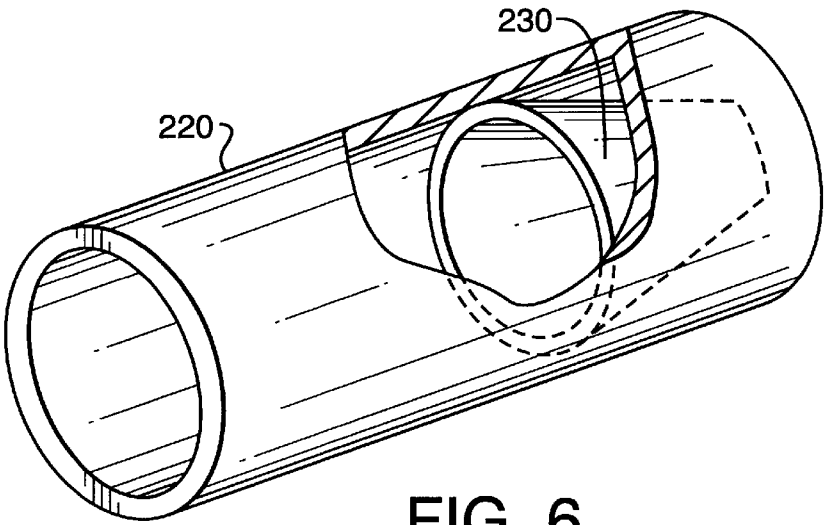
FIG. 6 is a perspective view of the tube of the constituent lighter of FIG. 1 containing yet another embodiment of the heat-conducting barrier with selected portions cut away and other selected portions in phantom lines.
Figure 7:
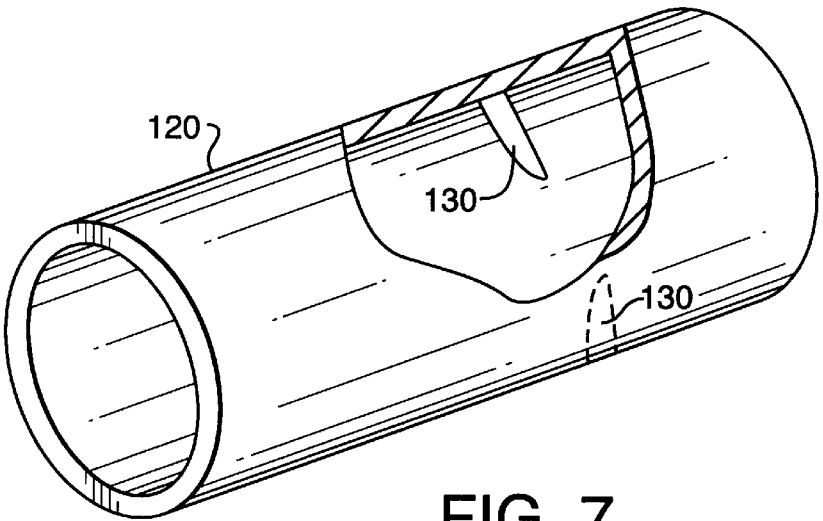
FIG. 7 is a perspective view of the tube of the constituent lighter of FIG. 1 containing still another embodiment of the heat-conducting barrier with selected portions cut away and other selected portions in phantom lines.
Figures 8, 8A:
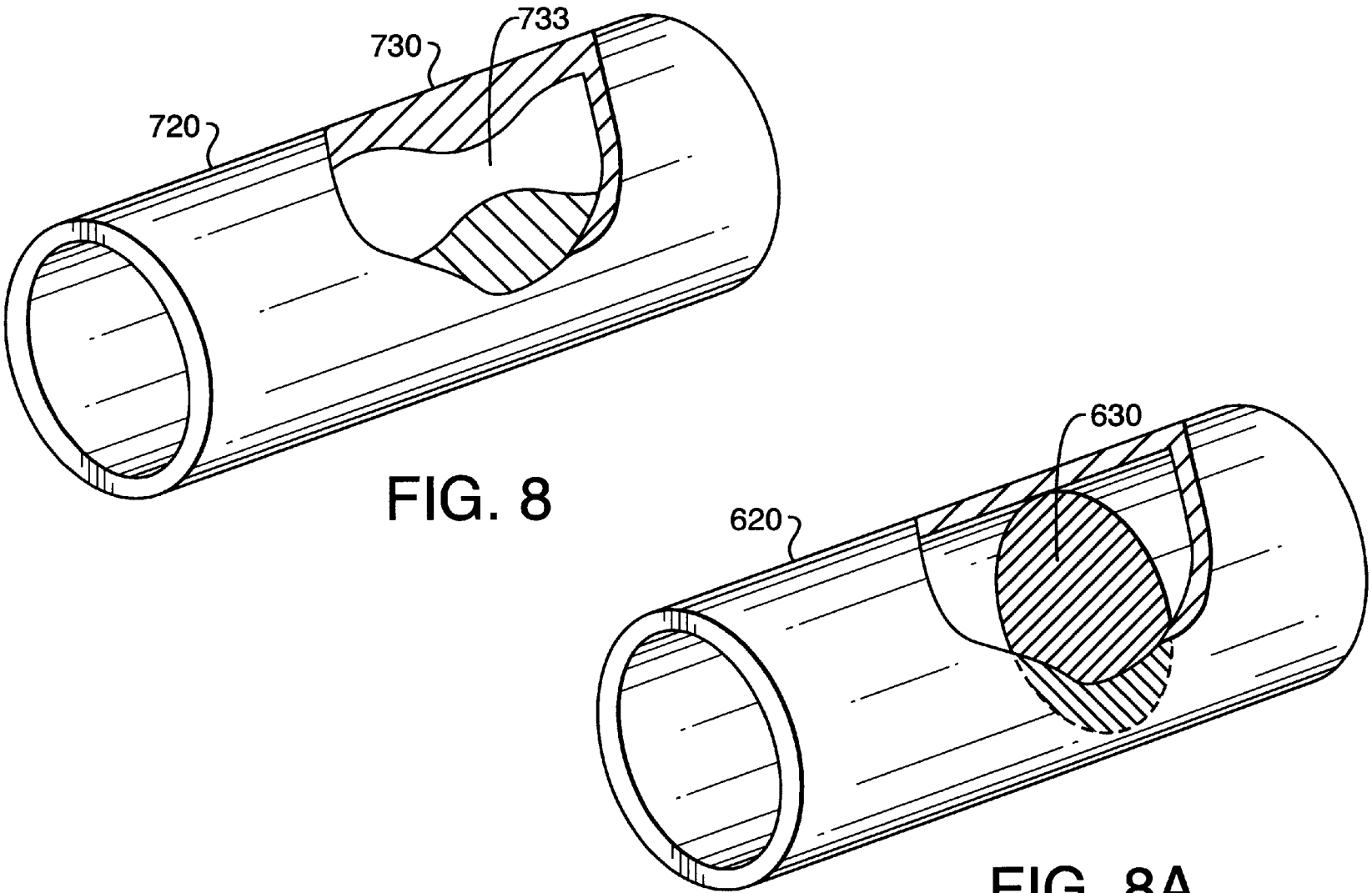
FIG. 8 is a perspective view of the tube of the constituent lighter of FIG. 1 containing still another embodiment of the heat-conducting barrier with selected portions cut away.
FIG. 8*a* is a perspective view of the tube of the constituent lighter of FIG. 1 containing a further embodiment of the heat-conducting barrier with selected portions cut away and other selected portions in phantom lines.

As shown in FIGS. 4–8*a*, the heat-conducting barrier may include various elements. For example, the heat-conducting barrier 430, shown in FIG. 4, includes an annular portion 431 separating the interior of the tube 420 from the rest of the smoking article. FIG. 5 shows a heat-conducting barrier 30 including at least one tab projecting from a side wall of tube 20. The heat-conducting barrier of the present invention may also include a frustoconical portion as displayed by the heat-conducting barrier 230 positioned in tube 220, shown in FIG. 6. Additionally, the heat-conducting barrier may include at least one pliable band, as indicated by the heat-conducting barrier 130 shown in FIG. 7, that will deform with the insertion of a cigarette, or similar smokable rod, into the interior of tube 120. The pliable band will then hold the cigarette in place, thereby preventing it from entering the flame chamber 140. Yet another embodiment, shown in FIG. 8, of the heat-conducting barrier 730 of the present invention includes a throat portion 733 that restricts access to the flame chamber 140 from the interior of the tube 720. FIG. 8*a* shows another embodiment of the heat conducting barrier 630 in which the barrier is a screen having a plurality of openings therein through which heat may be transferred from the burner to the interior of the tube 620.

Figure 10:
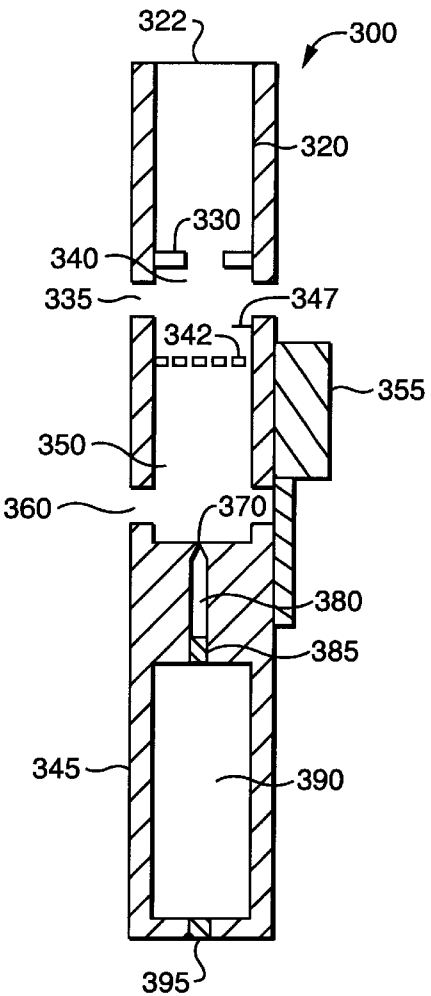
FIG. 10 is a cross-sectional view of the smoking article of FIG. 9*a* taken along line 10—10
Figure 9A:
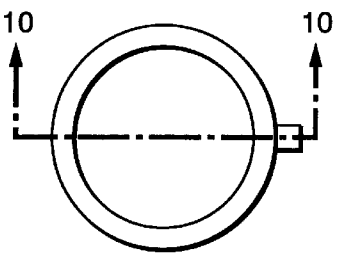
FIG. 9*a* is an end view of the smoking article of FIG. 9.
Figure 9:
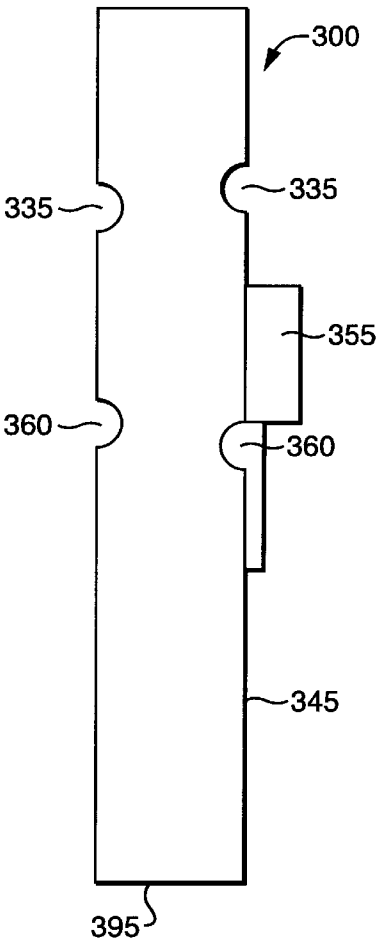
FIG. 9 is a side view of another embodiment of the smoking article containing the constituent lighter of the present invention.
Figure 17:
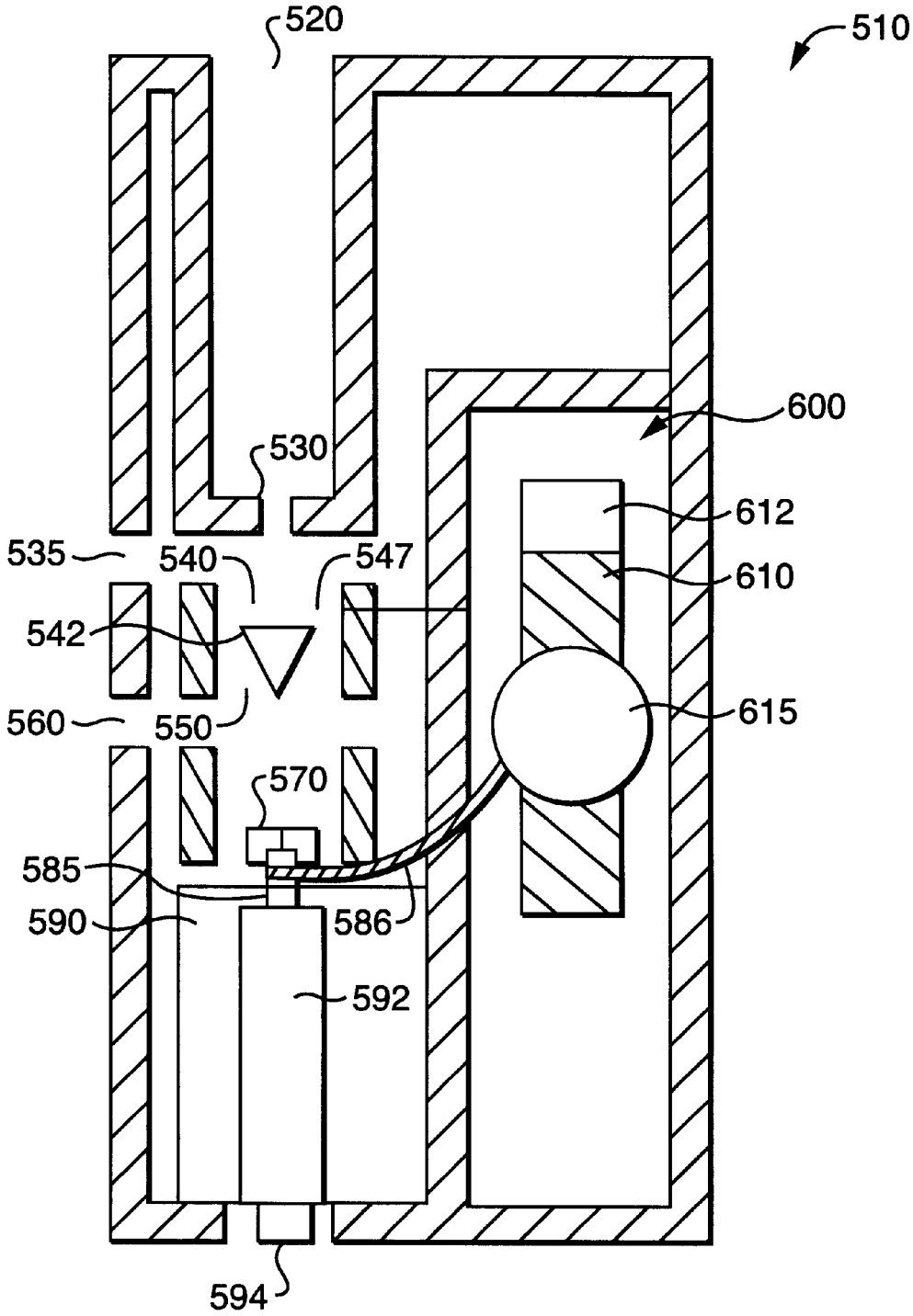
FIG. 17 is a cross-sectional view of another embodiment of the constituent lighter of the present invention containing a battery-powered spark ignitor.

As indicated previously, tube 20 is in flow communication with the heat-conducting barrier 30 and is sized to receive a rod containing a smokable material. The tube 20 is hollow and has an open distal end 22, as shown in FIG. 2. Tube 20 may be formed of any metallic, ceramic, polymeric, or natural material well known in the art and that is able to withstand the heat with the operation of the smoking article. For example, the tube 20 may be formed of ceramic, brass, steel, other metallic alloys, or composite materials. Indeed, more than one of the aforementioned materials may be used to form the tube 20. The tube 20 may include material with greater heat resistance within the portion thereof that tends to be subjected to higher temperatures during use. Alternatively, tube 20 may have an inner or outer sleeve included therein that assists in absorbing heat generated therein. Tube 20 may project from the apparatus, such as shown FIGS. 1–3, or it may be contained within the body of the smoking article, such as shown in FIGS. 9–10 and 17. Tube 20 also includes at least one opening 35 located either in a side wall thereof or in a portion of the smoking article between the tube 20 and the gas burner 11. Air may be drawn through opening 35 by puffing.

The constituent lighter 10 of the present invention may be included in smoking articles having any convenient shape well known in the art, such as a cigarette shape or pipe configuration. The smoking article 110, as shown in FIG. 3, may include a smokable material such as a tobacco or another aerosol-generating material disposed in a cigarette 119 or rod. Alternatively, the smoking article may include loose leaf tobacco or another aerosol-generating material that is not packed in a rod. The size, as well as the shape, of the smoking article may be similar to any conventional smoking article. For example, the constituent lighter 10 may be included in an article shaped like a cigarette, as shown in FIGS. 9, 9*a* and 10. The cigarette-shaped smoking article 300 includes similar components as those described above with a stream-lined body 345. A fuel storage container 390 with a refill valve 395 is in flow communication with a fuel line valve 385. A fuel line valve 385 is in communication with the fuel line 380 in flow communication with the fuel storage container 390. Fuel line 380 connects fuel storage container 390 to nozzle 370. Nozzle 370 is in flow communication with mixing chamber 350, into which opens air inlet 360. A flame holder 342 is in flow communication with mixing chamber 350 and is disposed at the inlet of flame chamber 340. A heat-conducting barrier 330 is disposed between an interior portion of said flame chamber 340 and an interior portion of a tube 320. At least one opening 335 is disposed in a side wall of said tube 320.

As previously indicated, a cigarette or similar smokable article may be inserted through the opening 322 and into the tube 320 of the cigarette-shaped smoking article 300. The cigarette is retained within the tube 320 by the heat-conducting barrier 330. The activator switch 355 may then be depressed, thereby releasing fuel from fuel storage container 390. The fuel travels through the gas burner and mixes with air drawn into mixing chamber 350 by the drop in static pressure caused by the flow through nozzle 370. The fuel/air mixture is then ignited by the ignitor 347 in flame chamber 340, in which is generated a stable, pre-mixed flame. The user may then puff on the cigarette, thereby drawing air into tube 320 through at least one opening 335. Heat transfer may then take place from flame chamber 340, past heat-conducting barrier 330 to the interior of tube 320 and ultimately to the cigarette. In this manner, the smoking article 300 may be used.

Figure 12:
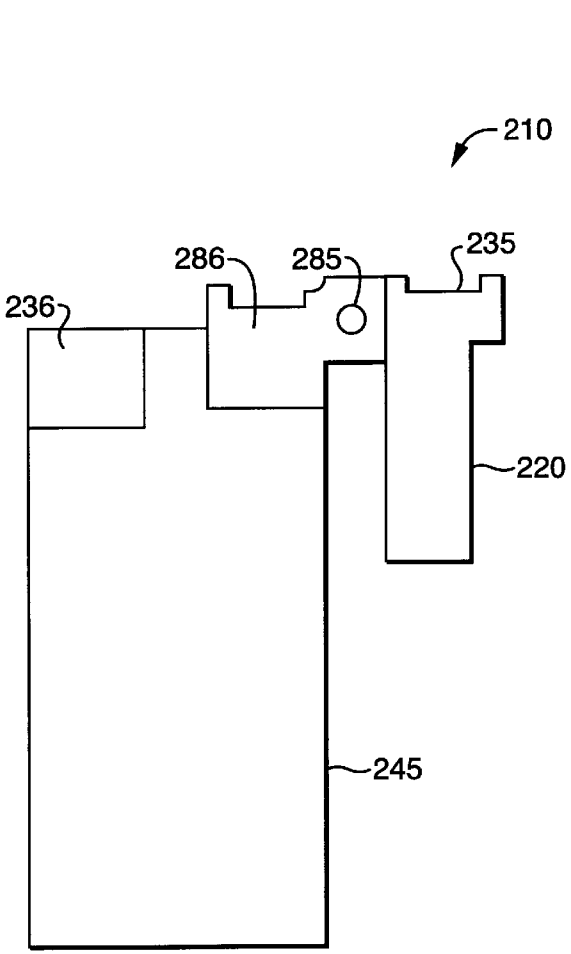
FIG. 12 is a side view of the constituent lighter of FIG. 11 with the hinge in the open position.
Figure 11:
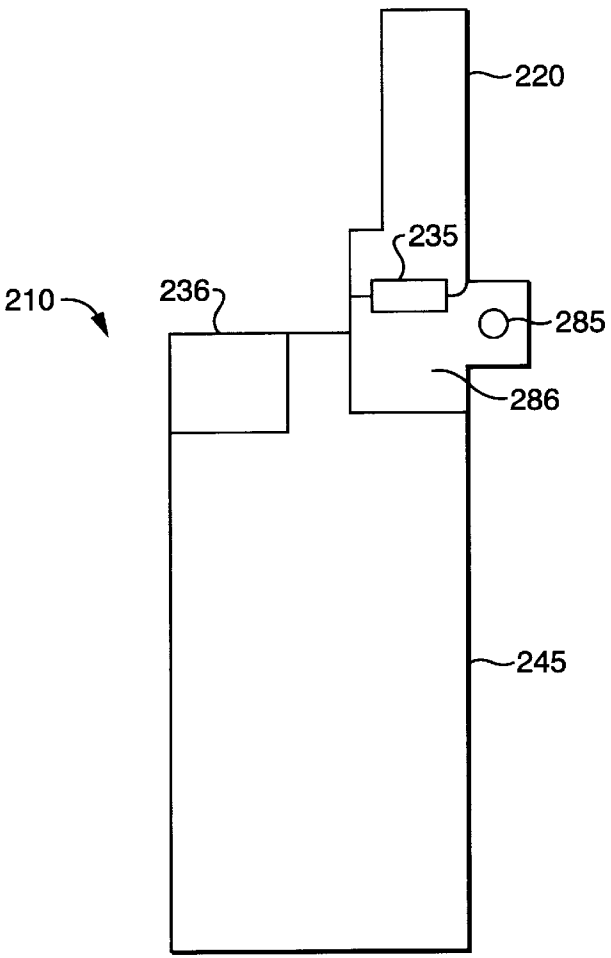
FIG. 11 is a side view of another embodiment of the constituent lighter of the present invention including a hinge.

As shown in FIGS. 11 and 12, the constituent lighter 210 of the present invention may also include a hinge 285 attached to tube 220. As shown in FIG. 11, the tube 220 is attached to the body 245, having an activation button 236 projecting therefrom by base 286. The hinge 285 attaches tube 220 to the remainder of the smoking article and allows the tube 220 to be rotated into a position in order to be stored. More particularly, tube 220 is movably attached by hinge 285 so as to be rotatable between a position wherein tube 220 is in flow communication with the gas burner, as shown in FIG. 11, and a position wherein the tube 220 is not in flow communication with the gas burner, as shown in FIG. 12. Hinge 285 may be attached to tube base 286 or directly to the body 245 of the constituent lighter 210. Furthermore, an opening 235 may be defined in the side wall of the tube 220 so that when the tube 220 is fully engaged to tube base 286, as shown in FIG. 11, the opening 235 is disposed between the end of tube 220 and the end of tube base 286. Alternatively, an opening may be fully disposed within base 286.

Figure 14:
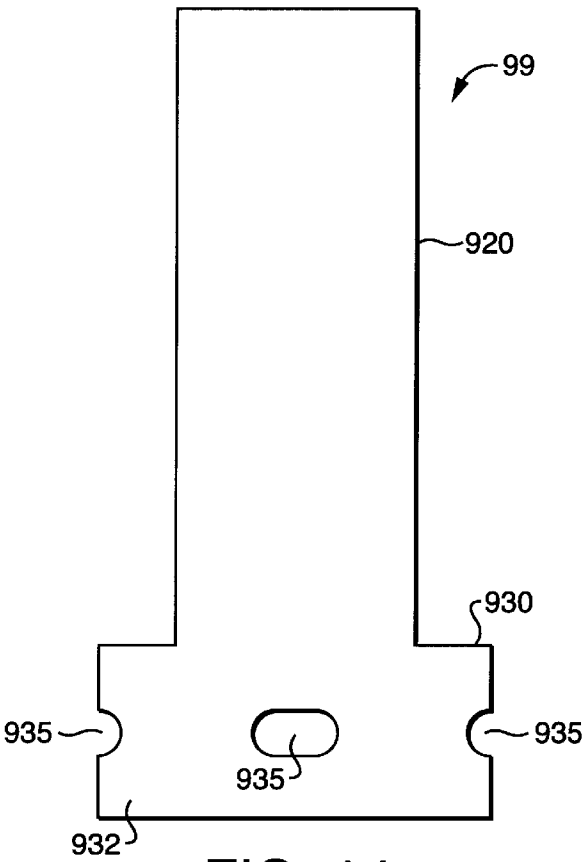
FIG. 14 is a side view of another embodiment of the attachment for the constituent lighter of the present invention.
Figure 13:
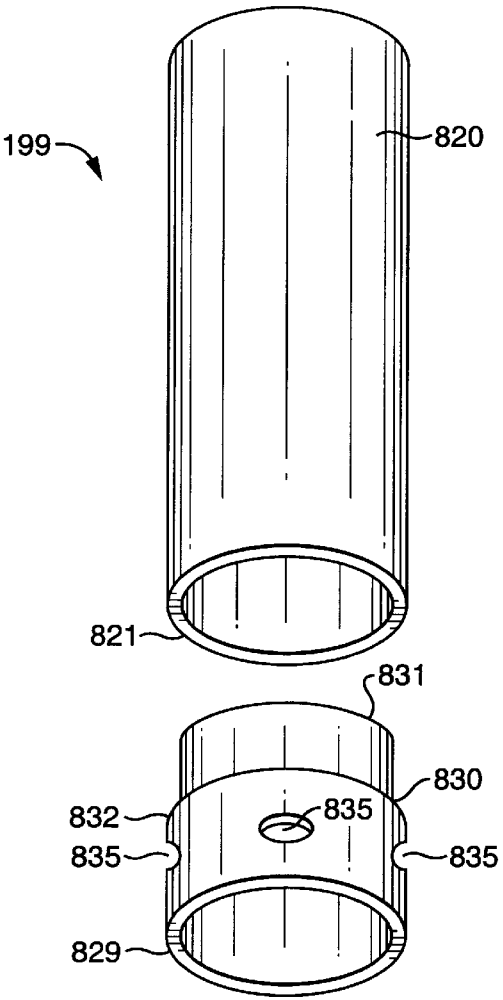
FIG. 13 is an exploded view of an attachment for the constituent lighter of the present invention.
Figure 15:
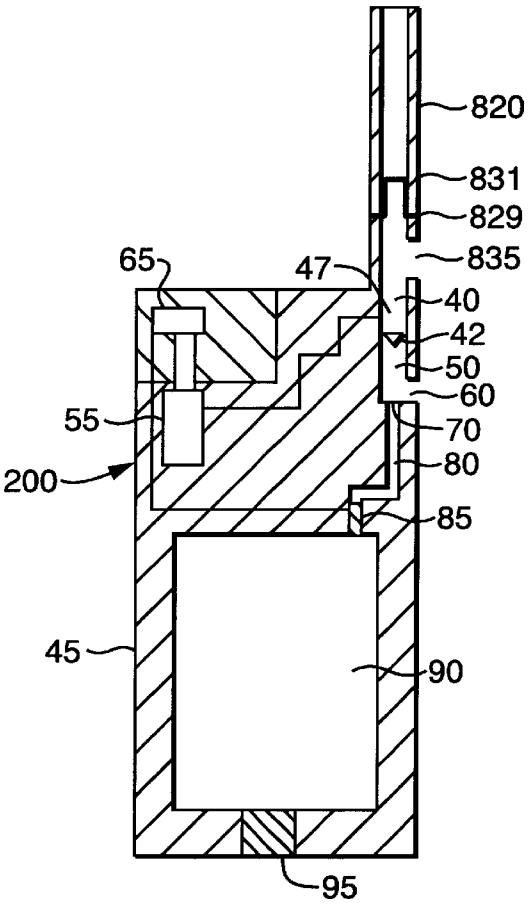
FIG. 15 is a cross-sectional view of the constituent lighter of the present invention including the attachment of FIG. 13.

The constituent lighter 10 of the present invention may also include an attachment 99 or 199, as shown in FIGS. 13 and 14. As shown in FIG. 14, the attachment 99 includes a hollow cylindrical tube 920 that has a shoulder 930 and a skirt 932 depending therefrom. At least one opening 935 may be disposed in the skirt 932. Attachment 99 is releasably attachable to a lighter at the end of skirt 932. As shown in FIG. 13, an alternative embodiment of the attachment of the present invention is attachment 199, which includes a tube 820 that is releasably attached to a tube base 829. Tube base 829 includes a tubular insert 831 which may be inserted into the proximal end 821 of tube 820. Tubular insert 831 projects from shoulder 830 from which depends a skirt 832. At least one opening 835 may be disposed in skirt 832. With both embodiments 99 and 199 of the attachment of the present invention, the attachments 99 and 199 are attached to the outlet of a burner of a lighter at skirt 832 and 932. FIG. 15 shows attachment 199 attached to a lighter 200. Tube 820 and tube base 829 are in flow communication with the flame chamber 40 of the lighter 200. Tube base 829 may be attached to lighter 200 by any effective means well known in the art, such as a fastener or frictional attachment. Tube 820 is frictionally attached to tube base 829 by the insertion of the tubular insert 831 into the interior of tube 820. Attachment 99 may be attached to a lighter in a similar fashion, thereby converting a conventional lighter into a lighter integral with a smoking article. Attachments 99 and 199 may be formed of any appropriate metallic, ceramic, polymeric or natural material well known in the art.

Figure 16:
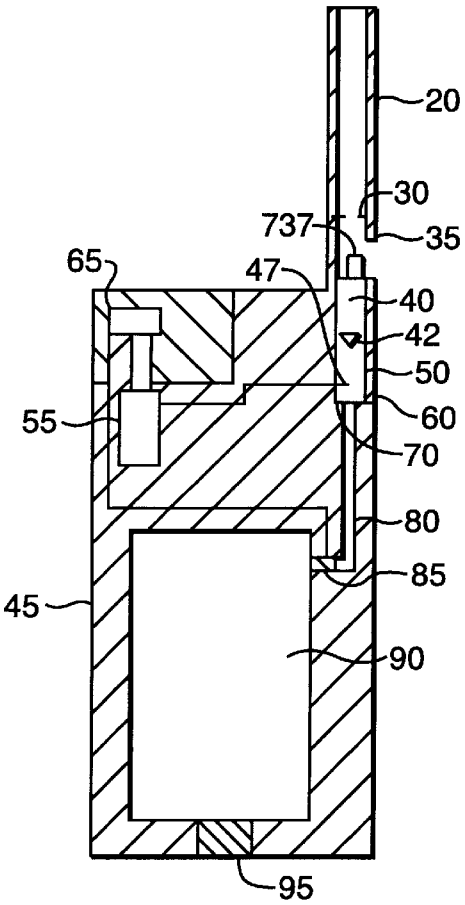
FIG. 16 is a cross-sectional view of the constituent lighter of the present invention containing a catalyst bed.

As shown in FIG. 16, the constituent lighter of the present invention may also include a catalyst bed 737. The catalyst bed 737 may be formed of any material well known in the art, such as a platinum or palladium coated ceramic or a metallic catalyst formed as a wire, mesh or wool. The catalyst bed 737, which is disposed downstream of the flame chamber 740, may also be configured in any shape well known in the art. Heat-conducting barrier 30 is disposed between catalyst bed 737 and an interior portion of tube 20. In operation, the catalyst bed 737 is activated by the pre-mixed flame generated within flame chamber 40. Heat transfer then occurs between the catalyst bed 737 and a cigarette disposed within tube 20. In this manner, the cigarette is heated sufficiently for it to be smoked without burning.

FIG. 17 shows yet another embodiment of the integral lighter of the present invention. The integral lighter 510 includes a tube 520 into which a rod containing a smokable material may be inserted. The heat-conducting barrier 530 is disposed at the end of tube 520 and is in flow communication with the flame chamber 540. An opening 535, through which air may be drawn by puffing, is in flow communication with the flame chamber 540 and the tube 520. A flame holder 542 is disposed between the flame chamber 540 and the mixing chamber 550, which also includes an air inlet 560 which opens to ambient. As with the other embodiments, a nozzle 570 is in flow communication with a fuel storage container 590. A fuel valve 585 is in flow communication with a fuel flow regulator and filling assembly 592 that assists in regulating the flow of the gaseous fuel from the fuel storage container 590 to the burner. A fuel fill valve and flow adjustment device 594 are disposed at the distal end of the fuel storage container 590. However, unlike the aforementioned embodiments, the embodiment set forth in FIG. 17 includes a battery-powered spark assembly 600, by which the gaseous fuel is ignited.

The battery-powered spark assembly 600 is disposed with the integral lighter 510 and includes a sliding activator 610 that activates the microswitch of the spark assembly. The sliding activator 610 is attached to a mechanical connector 586, which connects the activator to the fuel line valve 585. A button 615 is also attached to the sliding activator 610. The button 615 may be slid upward in channel 612 by the user in order to activate the ignitor 547 and release the fuel.

Figure 18:
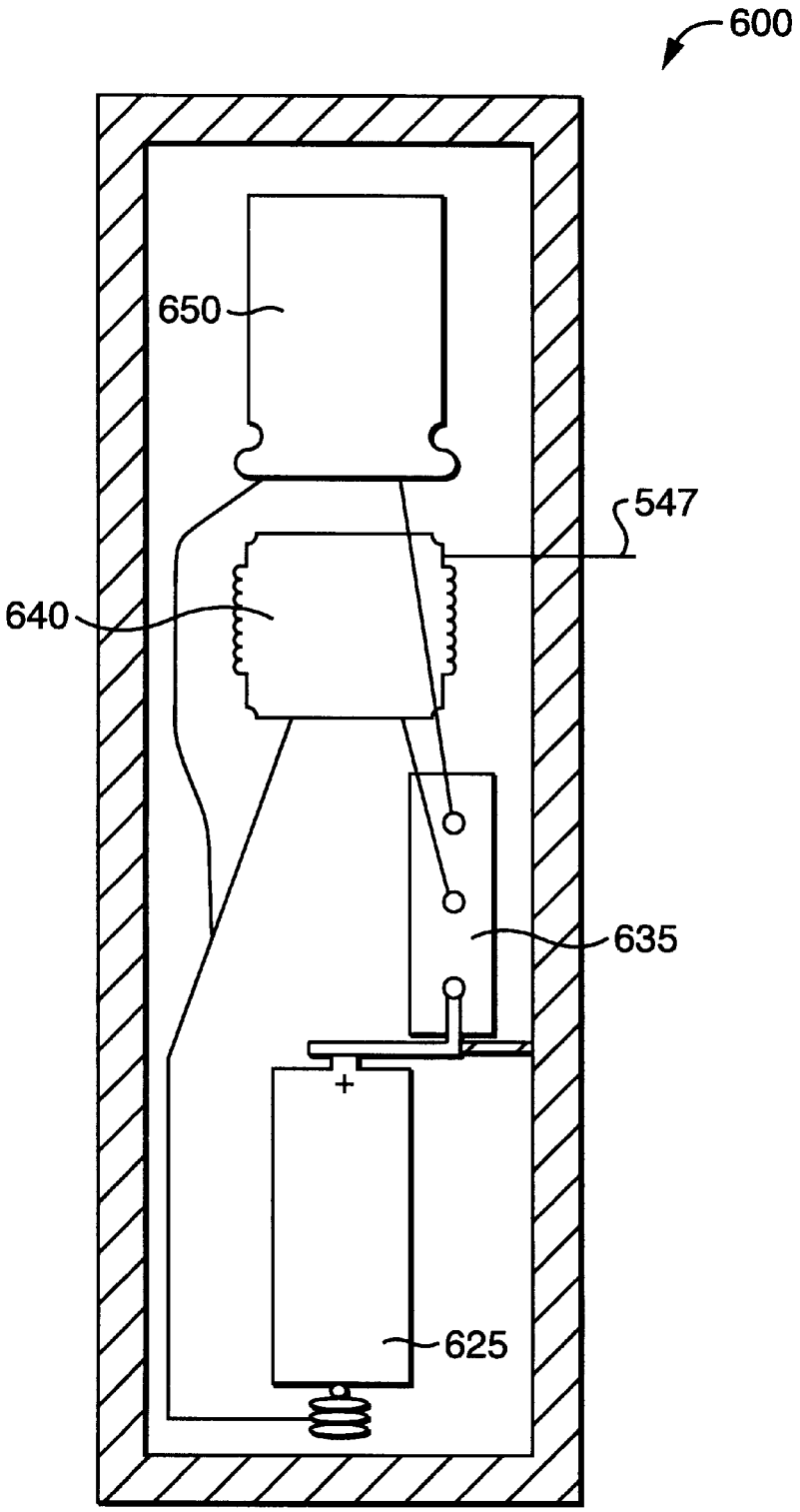
FIG. 18 is a rear cross-sectional view of the battery-powered spark ignitor assembly contained in the constituent lighter of FIG. 17.
Figure 18A:
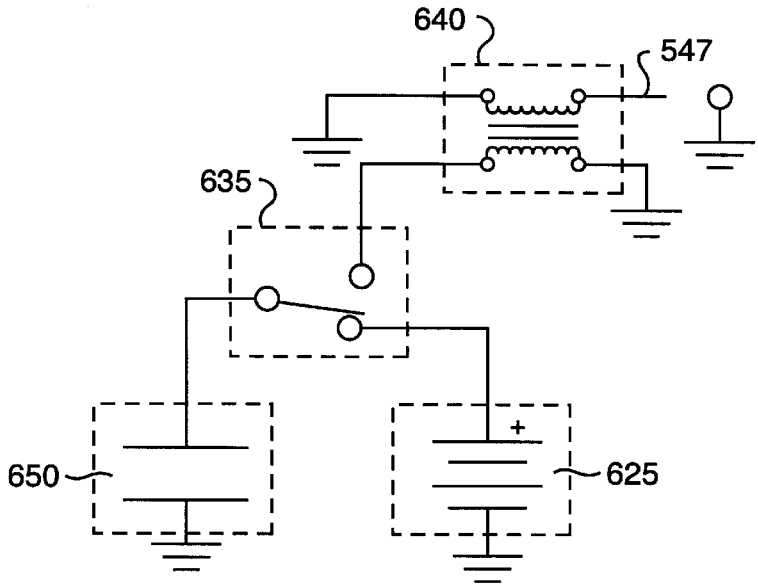
FIG. 18*a* is a circuit diagram of the battery-powered spark ignitor assembly.

As shown in FIG. 18, the battery-powered spark assembly 600 includes a capacitor 650 that alternatively forms an electrical circuit with battery 625 or with step up transformer 640. These alternative circuits are selected by the activation of a microswitch 635. The microswitch 635 is a single pole double throw, break-before-make type. As shown in FIG. 18*a*, the microswitch 635 is connected to capacitor 650 and is alternatively connected to either transformer 640 or battery 625. As known to those skilled in the art, capacitor 650 charges while in electrical connection with battery 625 and discharges when in circuit with step up transformer 640.

In operation, the button 615 moves the sliding activator 610 upward, thereby opening fuel line valve 585 via mechanical connector 586 just prior to activation of microswitch 635 by sliding activator 610. Once the microswitch 635 is activated, capacitor 650 discharges an electrical charge through the step up transformer 640, thereby generating a spark through ignitor 547. Release of button 615 causes the fuel line valve 585 to close, thereby returning the sliding activator 610 to the resting position. Return of the sliding activator 610 to its resting position, completes the circuit between the capacitor 650 and the battery 625. In this manner, the capacitor 650 may be recharged for the next activation.

Figure 19:
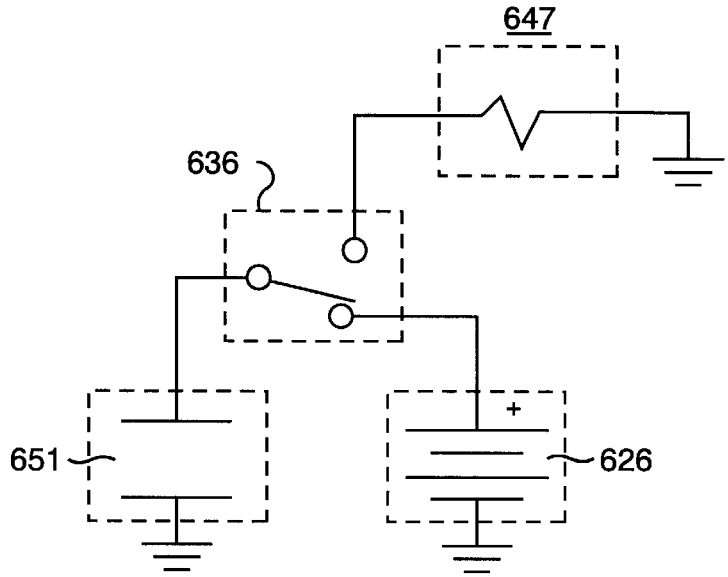
FIG. 19 is a circuit diagram of another embodiment of the constituent lighter of the present invention containing a battery-powered resistance heater ignitor assembly.

Additional alternative embodiments of the ignitor may be provided with the integral lighter of the present invention. For example, FIG. 19 shows a circuit diagram of another embodiment in which the ignitor is a resistance heater. The structure of this embodiment is similar to that of the battery-powered spark ignitor, but, instead of a step up transformer providing sufficient voltage to generate an arc at ignitor 547, a resistance heater 647 is provided in which an electrical charge from the capacitor 651 generates heat in the resistance heater 647. As with the battery-powered spark ignitor, the capacitor 651 is charged by battery 626, when microswitch 636 forms a circuit between the capacitor 651 and the battery 626. Sufficient heat is thereby generated as to elevate the temperature of the combustible fuel to its light off temperature, so as to initiate the combustion reaction. The resistance heater 647 may be formed of fine gauge platinum or palladium wire. Also, it may be formed of nichrome wire, film or globules having a platinum or palladium plating. The resistance heater 647 provides a silent ignition of the combustible fuel, whereas the spark ignitor and other embodiments, such as a piezoelectric ignitor, generate sound from either the formation of an electrical arc or the striking force necessary to form an electrical current in the piezoelectric element.

The foregoing detailed descriptions of the preferred embodiments of the present invention are given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A constituent lighter to be integrally combined with a smoking article comprising:

a body including a gas burner having a mixing chamber in flow communication with at least one first air inlet disposed within said body, said first air inlet being open to ambient;

a tube having a first open end and a second end opposed to said first end, said second end of said tube being in flow communication with said gas burner;

a second air inlet in flow communication with said gas burner and an interior portion of said tube; and a heat conducting barrier, disposed between said gas burner and said interior portion of said tube, positioned to prevent ignition of said smoking article.

2. The constituent lighter of claim 1, including a hinge connecting said tube to said body.

3. The constituent lighter of claim 1, said gas burner including a nozzle in flow communication with said mixing chamber and said at least one first air inlet.

4. The constituent lighter of claim 1, said barrier including a frustoconical portion therein.

5. The constituent lighter of claim 1, said barrier including an annular opening therein.

6. The constituent lighter of claim 1, said barrier including at least one pliable band.

7. The constituent lighter of claim 1, said barrier including a throat portion therein.

8. The constituent lighter of claim 1, said tube including a shoulder connected to said second end of said tube and a skirt depending from said shoulder.

9. The constituent lighter of claim 8, wherein said second air inlet is disposed within a side wall of said skirt.

10. The constituent lighter of claim 8, wherein a first portion of said tube is releasably attached to a second portion of said tube including said shoulder and said skirt.

11. The constituent lighter of claim 1, said gas burner including a catalyst bed therein.

12. The constituent lighter of claim 11, said barrier being disposed between said interior portion of said tube and said catalyst bed.

13. The constituent lighter of claim 11, said catalyst bed including platinum.

14. The constituent lighter of claim 11, said catalyst bed including palladium.

15. The constituent lighter of claim 1, further including an ignitor in flow communication with said mixing chamber.

16. The constituent lighter of claim 15, said ignitor including a piezoelectric element.

17. The constituent lighter of claim 15, said ignitor including a battery-powered resistance heater.

18. The constituent lighter of claim 17, said battery-powered resistance heater including platinum.

19. The constituent lighter of claim 17, said battery-powered resistance heater including palladium.

20. The constituent lighter of claim 17, said battery-powered resistance heater including nichrome.

21. The constituent lighter of claim 17, said battery-powered resistance heater including a capacitor and a resistor.

22. The constituent lighter of claim 15, said ignitor including a battery-powered spark assembly.

23. The constituent lighter of claim 22, said battery-powered spark assembly including a capacitor, a step-up transformer and a microswitch.

24. The constituent lighter of claim 1, said gas burner in flow communication with a fuel storage container containing a gaseous fuel.

25. The constituent lighter of claim 24, said gaseous fuel including a low molecular weight hydrocarbon.

26. The constituent lighter of claim 25, said low molecular weight hydrocarbon selected from the group consisting essentially of methane, ethane, propane, butane, and acetylene.

27. The constituent lighter of claim 24, said gaseous fuel including hydrogen.

28. The constituent lighter of claim 24, said gaseous fuel including carbon monoxide.

29. The constituent lighter of claim 1, further comprising a smoking article having smokable material including tobacco.

30. The constituent lighter of claim 29, further comprising tobacco disposed within a cigarette.

31. A constituent lighter to be integrally combined with a smoking article comprising:

a body including a gas burner, a portion of said gas burner being in flow communication with at least one first opening to ambient in said body;

a tube having an open end and at least one second opening to ambient in a side wall thereof, said tube being in flow communication with said gas burner; and a heat conducting barrier, disposed between an interior portion of said tube and said gas burner, positioned to prevent ignition of said smoking article.

32. The constituent lighter of claim 31, said barrier having a frustoconical portion therein.

33. The constituent lighter of claim 31, said barrier including an annular opening therein.

34. The constituent lighter of claim 31, said barrier disposed within a proximal end of said tube.

35. The constituent lighter of claim 31, said barrier including a pliable band.

36. The constituent lighter of claim 31, said barrier including a throat portion therein.

37. The constituent lighter of claim 31, said gas burner including a nozzle in flow communication with at least one second opening.

38. The constituent lighter of claim 31, said gas burner including a fuel storage container containing a gaseous fuel.

39. The constituent lighter of claim 38, said gaseous fuel including a low molecular weight hydrocarbon.

40. The constituent lighter of claim 39, said low molecular weight hydrocarbon selected from the group consisting essentially of methane, ethane, propane, butane, and acetylene.

41. The constituent lighter of claim 39, said gaseous fuel including hydrogen.

42. The constituent lighter of claim 39, said gaseous fuel including carbon monoxide.

43. The constituent lighter of claim 31, further comprising a hinge connecting said tube to said body.

44. The constituent lighter of claim 31, including a catalyst bed therein.

45. The constituent lighter of claim 44, said catalyst bed including platinum.

46. The constituent lighter of claim 44, said catalyst bed including palladium.

47. The constituent lighter of claim 31, further including an ignitor in flow communication with said mixing chamber.

48. The constituent lighter of claim 47, said ignitor including a piezoelectric element.

49. The constituent lighter of claim 47, ignitor including a battery-powered resistance heater.

50. The constituent lighter of claim 49, said battery-powered resistance heater including platinum.

51. The constituent lighter of claim 49, said battery-powered resistance heater including palladium.

52. The constituent lighter of claim 49, said battery-powered resistance heater including nichrome.

53. The constituent lighter of claim 49, said battery-powered resistance heater including a capacitor and a resistor.

54. The constituent lighter of claim 47, said ignitor including a battery-powered spark assembly.

55. The constituent lighter of claim 54, said battery-powered spark assembly including a capacitor, a step-up transformer and a microswitch.

56. The constituent lighter of claim 31, further comprising a smoking article having smokable material including tobacco.

57. The constituent lighter of claim 56, further comprising tobacco disposed within a cigarette.

* * * * *